US010428769B2

(12) United States Patent
Uchida

(10) Patent No.: US 10,428,769 B2
(45) Date of Patent: Oct. 1, 2019

(54) FUEL VAPOR TREATMENT APPARATUS

(71) Applicant: DENSO CORPORATION, Kariya, Aichi-pref. (JP)

(72) Inventor: Kimio Uchida, Kariya (JP)

(73) Assignee: DENSO CORPORATION, Kariya (JP)

( * ) Notice: Subject to any disclaimer, the term of this patent is extended or adjusted under 35 U.S.C. 154(b) by 28 days.

(21) Appl. No.: 15/928,223

(22) Filed: Mar. 22, 2018

(65) Prior Publication Data

US 2018/0274492 A1 Sep. 27, 2018

(30) Foreign Application Priority Data

Mar. 27, 2017 (JP) ..... 2017-60799

(51) Int. Cl.

| | |
|---|---|
| ***F02M 25/00*** | (2006.01) |
| ***F02M 25/08*** | (2006.01) |
| ***F02D 41/00*** | (2006.01) |
| ***F02D 41/14*** | (2006.01) |

(52) U.S. Cl.

CPC ..... *F02M 25/0827* (2013.01); *F02D 41/0042* (2013.01); *F02D 41/0045* (2013.01); *F02D 41/1456* (2013.01); *F02M 25/0836* (2013.01); *F02M 25/0872* (2013.01); *F02D 41/0035* (2013.01); *F02M 25/0854* (2013.01)

(58) Field of Classification Search

CPC ..... F02M 25/0827; F02M 25/0836; F02M 25/0872; F02M 25/0854; F02D 41/1456; F02D 41/0045; F02D 41/0042; F02D 41/0035

See application file for complete search history.

(56) References Cited

U.S. PATENT DOCUMENTS

| | | | | |
|---|---|---|---|---|
| 5,216,991 | A * | 6/1993 | Iida | F02D 31/004 123/339.23 |
| 5,245,973 | A * | 9/1993 | Otsuka | F02M 25/0854 123/198 D |
| 9,523,317 | B1 * | 12/2016 | Li | F02D 41/0042 |
| 10,138,846 | B1 * | 11/2018 | Dudar | F02M 25/0809 |
| 2006/0130568 | A1 | 6/2006 | Ishii et al. | |
| 2015/0121864 | A1 * | 5/2015 | Surnilla | F02D 41/0052 60/605.2 |
| 2015/0198122 | A1 * | 7/2015 | Vigild | F02M 25/0836 123/520 |

* cited by examiner

*Primary Examiner* — Hieu T Vo
*Assistant Examiner* — Sherman D Manley
(74) *Attorney, Agent, or Firm* — Nixon & Vanderhye P.C.

(57) ABSTRACT

A fuel vapor treatment apparatus is provided with an air-fuel-ratio obtaining portion and a clogging determining portion. The air-fuel-ratio obtaining portion obtains the air-fuel ratio. The clogging determining portion determines whether a purge line is clogged based on a maximum variation amount of air-fuel ratio. In a case where no clogging is occurred in the purge line, the air-fuel ratio significantly fluctuates temporarily. In a case where at least a part of the purge line is fully clogged, even when a purge valve receives a valve opening command to be opened, fuel vapor cannot be introduced into the engine, so that the air-fuel ratio is not varied. In view of an air-fuel ratio variation, it is determined whether the purge line is clogged.

4 Claims, 8 Drawing Sheets

FUEL VAPOR TREATMENT APPARATUS

CROSS-REFERENCE TO RELATED APPLICATION

This application is based on Japanese Patent Application No. 2017-60799 filed on Mar. 27, 2017, the disclosure of which is incorporated herein by reference.

TECHNICAL FIELD

The present disclosure relates to a fuel vapor treatment apparatus.

BACKGROUND ART

Conventionally, a fuel vapor treatment apparatus has been known, which treats fuel vapor generated in a fuel tank by introducing the fuel vapor into an engine. In the fuel vapor treatment apparatus, the fuel vapor is temporarily adsorbed by a canister. When a purge valve is opened according to a driving condition of the engine, the fuel vapor is suctioned into the engine.

In a fuel vapor treatment apparatus shown in JP 2006-177199A, when an engine is shut down, a purge valve disposed in a purge line is closed and a pressure drop in the purge line is detected to determine whether a fuel leak from the purge line occurs. When no fuel leak occurs, the pressure in the purge line falls below an atmospheric pressure. When a fuel leak occurs, the pressure in the purge line converges to the atmospheric pressure. Based on this, a determination of fuel leak is performed.

Although the fuel vapor treatment apparatus shown in JP 2006-177199A can determine whether a fuel leak from a purge line occurs, it cannot determine whether a clogging of the purge line occurs. For example, even if a fuel leak from a purge line occurs, it is determined that no fuel leak occurs in a case where the purge line is clogged between a leak portion and a pressure sensor. Therefore, it is required to determine whether a purge line is clogged in addition to a determination of a fuel leak.

SUMMARY

It is an object of the present disclosure to provide a fuel vapor treatment apparatus which is able to determine whether a purge line is clogged.

According to the present disclosure, a fuel vapor treatment apparatus is applied to an engine which controls an injection quantity of a fuel injector so that an air-fuel ratio is kept at a target air-fuel ratio. The fuel vapor treatment apparatus is provided with a canister, a first pipe, a second pipe, a purge valve, a valve driving portion, an air-fuel-ratio obtaining portion and a clogging determining portion.

The first pipe defines a first passage fluidly connecting a fuel tank and the canister with each other. The second pipe defines a second passage fluidly connecting the canister and an intake passage. The purge valve opens and closes the second passage. The valve driving portion drives the purge valve. The air-fuel-ratio obtaining portion obtains the air-fuel ratio.

The clogging determining portion determines an occurrence of clogging in a purge line or determines a clogging degree of the purge line based on the air-fuel ratio which the air-fuel-ratio obtaining portion obtains in a time period from when the purge valve is opened until when a specified time elapses. The purge line is defined by the first passage, the second passage and an inner passage of the purge valve.

In a case where no clogging is occurred in the purge line, a fuel injection quantity control is delayed a little when the purge valve is opened. Thus, the air-fuel ratio significantly fluctuates temporarily. Meanwhile, in a case where at least a part of the purge line is fully clogged, even when the purge valve receives a valve opening command to be opened, the fuel vapor cannot be introduced into the engine. Thus, the air-fuel ratio is not varied. Also, in a case where at least a part of the purge line is partially clogged, even when the purge valve receives a valve opening command to be opened, the fuel vapor is less introduced into the engine. Thus, the air-fuel ratio is less varied relatively. The clogging determining portion determines a clogging of the purge line in view of the variation in air-fuel ratio.

When the passage is fully clogged, the cross-sectional passage area of the passage is zero. When the passage is partially clogged, the cross-sectional passage area is decreased from an initial cross-sectional passage area. Foreign matters accumulate in the passage or the pipe is deformed from an initial design shape, so that a passage area is decreased. The clogging degree represents how much cross-sectional passage area is decreased from the initial cross-sectional passage area.

DETAILED DESCRIPTION

Figure 1:
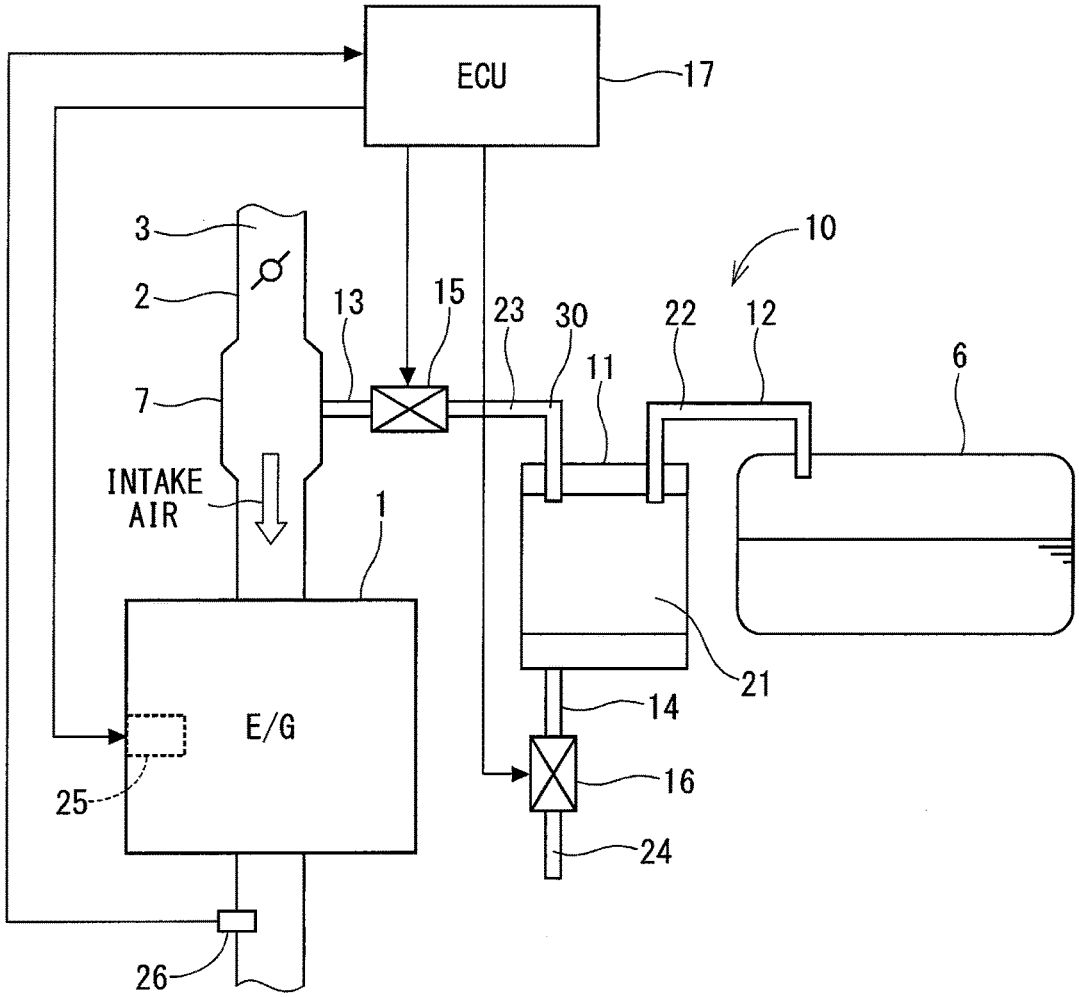
FIG. 1 is a chart for explaining an engine to which a fuel vapor treatment apparatus is applied according to a first embodiment.

Referring to drawings, a plurality of embodiments of the present disclosure will be described, hereinafter. In the embodiments, substantially the same components are designated by the same reference numeral, and duplicated description is omitted.

First Embodiment

According to a first embodiment, a fuel vapor treatment apparatus is applied to an engine. As shown in FIG. 1, an engine 1 has a combustion chamber in which fuel is combusted. Fresh air is introduced into a combustion chamber through an intake passage 3 defined by an intake pipe 2. Combusted gas is discharged to outside through an exhaust passage 5 defined by an exhaust pipe 4. A fuel vapor treatment apparatus 10 introduces fuel vapor generated in a fuel tank 6 into the engine 1 to restrict a release of the fuel vapor into atmosphere.

(Fuel Vapor Treatment Apparatus)

Referring to FIG. 1, a configuration of the fuel vapor treatment apparatus 10 will be described, hereinafter.

As shown in FIG. 1, the fuel vapor treatment apparatus 10 is provided with a canister 11, pipes 12-14, a purge valve 15, a fresh air introduce valve 16 and an ECU 17.

The canister 11 has an adsorbent 21 which adsorbs fuel vapor temporarily.

A first pipe 12 defines a first passage 22 fluidly connecting the fuel tank 6 and the canister 11 with each other. The first passage 22 is for introducing a fuel vapor from the fuel tank 6 to the canister 11.

The second pipe 13 defines a second passage 23 fluidly connecting the canister 11 and an intake manifold 7 of the intake pipe 2 with each other. The second passage 23 is for introducing the fuel vapor from the canister 11 to the engine 1.

The third pipe 14 defines a third passage 24 fluidly connecting the canister 11 and an exterior space with each other. The third passage 24 is for introducing fresh air to the canister 11.

The purge valve 15 is disposed in the second passage 23 to open and close the second passage 23 according to a command transmitted from the ECU 17. When the purge valve 15 opens the second passage 23, the canister 11 communicates with the intake manifold 7 as long as the second passage 23 is not fully clogged with foreign matters.

The fresh air introduce valve 16 is disposed in the third passage 24 to open and close the third passage 24 according to a command transmitted from the ECU 17. When the fresh air introduce valve 16 opens the third passage 24, the canister 11 communicates with the exterior space as long as the third passage 24 is not fully clogged by foreign matters.

The clogging of the passage is occurred when the foreign matters accumulate in the passage or the pipe is deformed from an initial design shape, so that a cross-sectional passage area is decreased. When the passage is fully clogged, the cross-sectional passage area of the passage is zero. When the passage is partially clogged, the cross-sectional passage area is decreased from an initial cross-sectional passage area.

The ECU 17 has a microcomputer, a drive circuit and the like. The ECU 17 is electrically connected to a fuel injector, an A/F sensor 26, the purge valve 15, and the fresh air introduce valve 16. The ECU 17 drives the fuel injector 25, the purge valve 15, and the fresh air introduce valve 16 according to the driving operation of a vehicle.

The fuel injector 25 is fluidly connected to the fuel tank 6 through a fuel supply passage and a fuel pump, which are not shown, and injects the high-pressure fuel into the engine 1. The A/F sensor 26 is disposed in the exhaust passage 5 to detect an air-fuel ratio.

When the purge valve 15 and the fresh air introduce valve 16 open the second passage 23 and the third passage 24 respectively, air in the canister 11 is suctioned by negative pressure generated in the intake manifold 7, so that fresh air is introduced into the canister 11. When the fresh air passes through the adsorbent 21, the adsorbed fuel vapor is purged from the adsorbent 21 and introduced into the combustion chamber of the engine 1.

(Function of ECU)

Referring to FIGS. 1 to 4, a configuration of the ECU 17 will be described in detail.

In the following description, an initial air-fuel ratio represents an air-fuel ratio of when the purge valve 15 starts to be opened. Moreover, the first passage 22, the second passage 23, the third passage 24, an internal passage of the purge valve 15, and an internal passage of the fresh air introduce valve 16 define a purge line 30.

Figure 2:
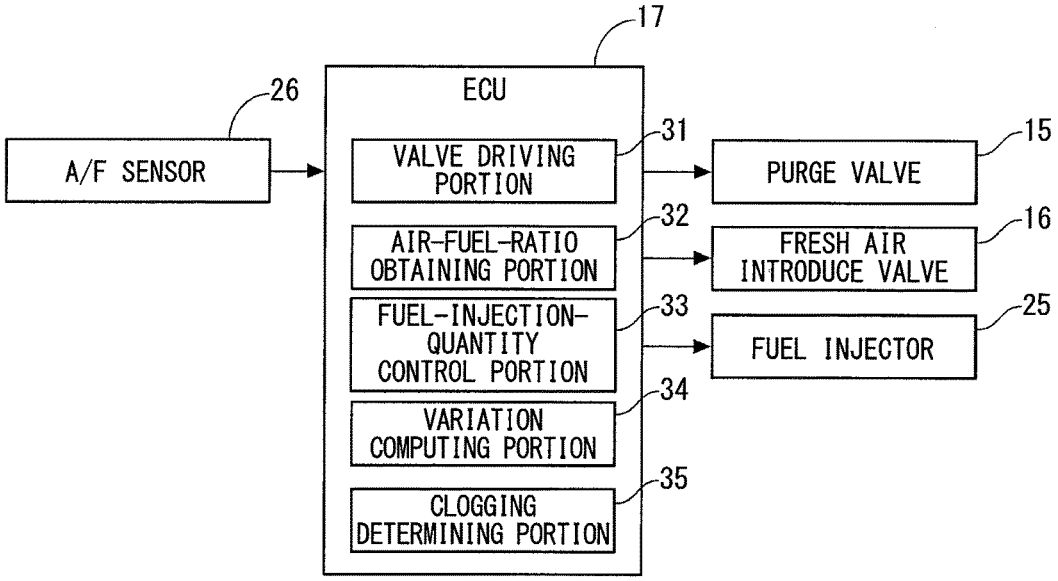
FIG. 2 is a chart for explaining functional portions of an ECU which is shown in FIG. 1.

As shown in FIG. 2, the ECU 17 has a valve driving portion 31, an air-fuel-ratio obtaining portion 32, and a fuel-injection-quantity control portion 33. The valve driving portion 31 drives the purge valve 15 and the fresh air introduce valve 16. The air-fuel-ratio obtaining portion 32 obtains an air-fuel ratio from the A/F sensor 26. The fuel-injection-quantity control portion 33 controls the injection quantity of the fuel injector 25 so that the air-fuel ratio agrees with a target air-fuel ratio.

Figure 3:
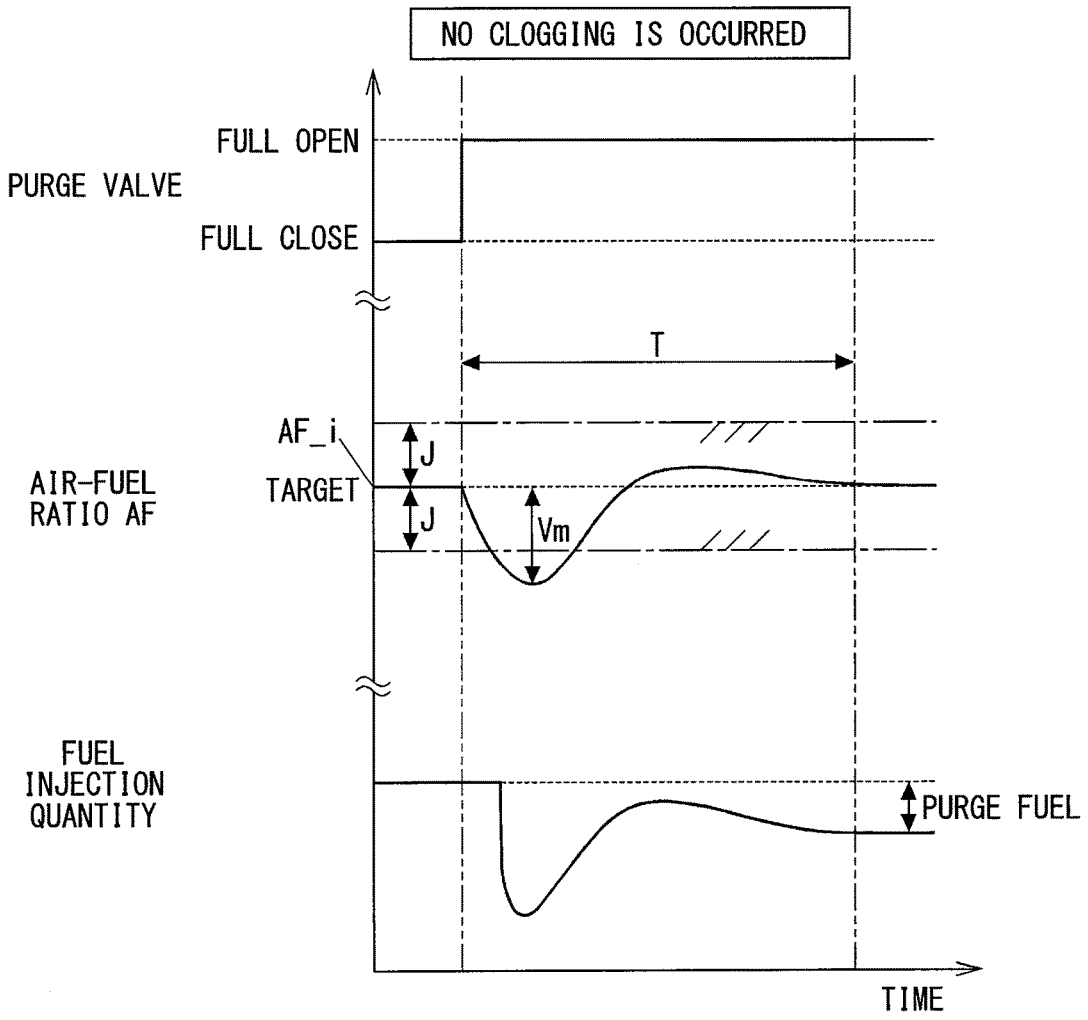
FIG. 3 is a time chart showing a position of a purge valve, an air-fuel ratio and a variation in fuel injection quantity in a case where no clogging is occurred in a purge line.

In a case where no clogging is occurred in the purge line 30, since the fuel injection quantity control is delayed a little when the purge valve 15 is opened, the air-fuel ratio significantly fluctuates temporarily as shown in FIG. 3.

Figure 4:
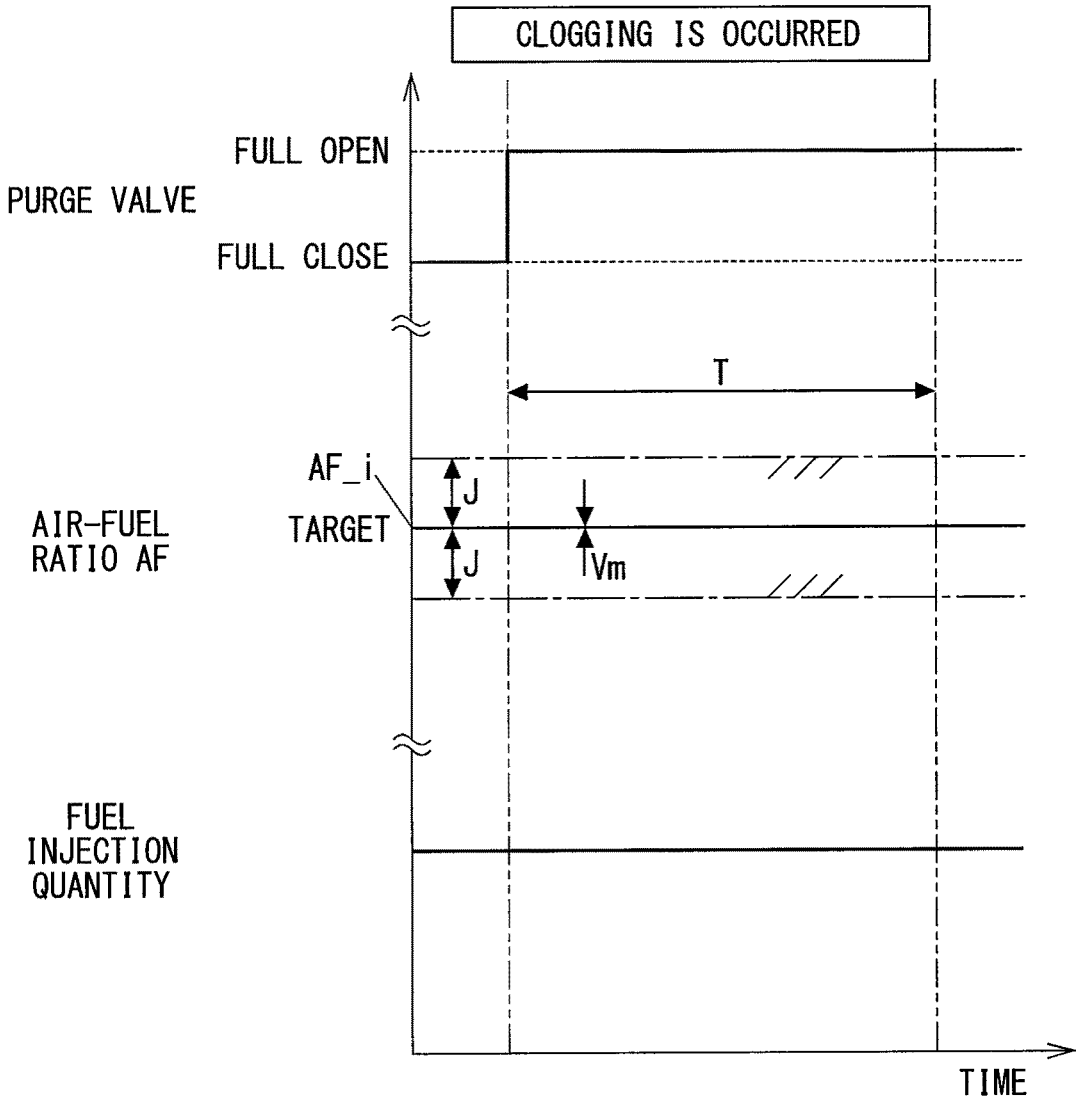
FIG. 4 is a time chart showing a position of a purge valve, an air-fuel ratio and a variation in fuel injection quantity in a case where a clogging is occurred in a purge line.

However, in a case where at least a part of the purge line 30 is clogged, even when the purge valve 15 receives a valve opening command to be opened, the fuel vapor cannot be introduced into the engine 1, so that the air-fuel ratio is not varied, as shown in FIG. 4. For example, when the first passage 22 is clogged with foreign matters, the canister 11 cannot adsorb the fuel vapor generated in the fuel tank 6. Also, when the second passage 23 or the third passage 24 is clogged, or when the purge valve 15 or the fresh air introduce valve 16 is faultily closed, the purge line from the exterior space to the intake manifold 7 is interrupted. Thus, the fuel vapor cannot be introduced into the engine 1 even when the valve opening command is transmitted to the purge valve 15 and the fresh air introduce valve 16.

As shown in FIG. 2, the ECU 17 has a variation computing portion 34 and a clogging determining portion 35 as a functional portion which determines whether the purge line 30 is clogged based on a variation in air-fuel ratio. In a time period from when the purge valve 15 is opened until when a specified time "T" elapses, the air-fuel ratio obtained by the air-fuel-ratio obtaining portion 32 varies from an initial air-fuel ratio AF_i. The variation computing portion 34 computes a maximum variation amount Vm in the air fuel ratio. (refer to FIGS. 3 and 4) The clogging determining portion 35 determines that the purge line 30 is clogged when the maximum variation amount Vm is less than or equal to a threshold value "J". (refer to FIG. 4) It is determined that the purge line 30 is clogged when the purge line 30 is fully clogged or when the purge line 30 is partially clogged so that the fuel vapor is not effectively treated by the fuel vapor treatment apparatus 10. The clogging determining portion 35 determines that the purge line 30 is not clogged when the maximum variation amount Vm is greater than the threshold value "J". (refer to FIG. 3) In the present embodiment, the threshold value "J" is a predetermined value.

Each functional portion 31-35 may be configured by hardware including an exclusive electronic circuit, software executing a program stored in a ROM, or a combination of hardware and software. The functional portions 31-35 which are configured by hardware or software are suitably selected.

(Processing of ECU)

Figure 5:
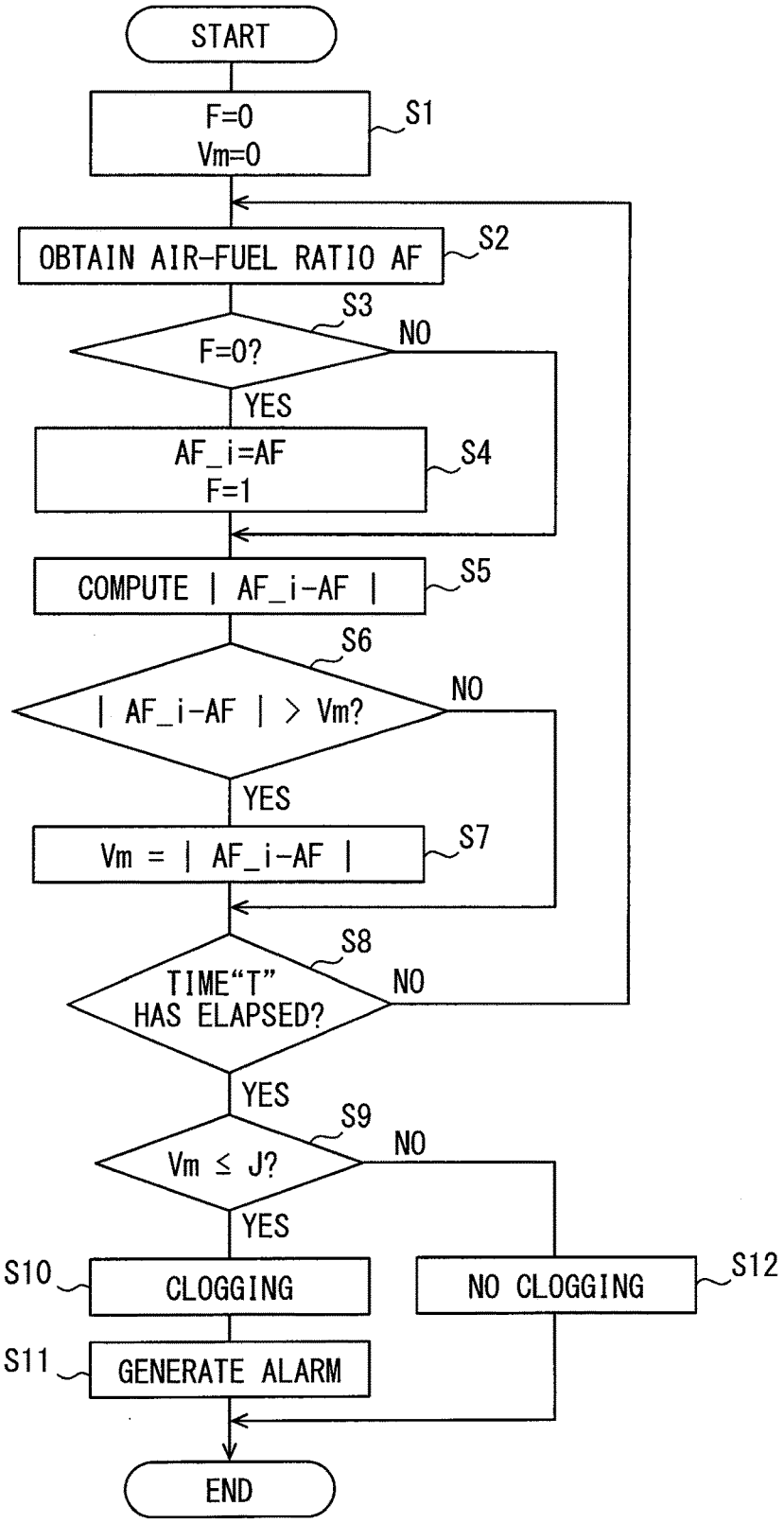
FIG. 5 is a flowchart showing a processing which an ECU shown in FIG. 1 performs.

Referring to FIG. 5, a processing which the ECU 17 performs to determine whether the purge line 30 is clogged will be described, hereinafter. This processing is performed while a processing for controlling the purge valve 15 and the fresh air introduce valve 16 and a processing for controlling the air-fuel ratio to the target air-fuel ratio are performed. When the purge valve 15 is opened, the processing is performed.

In S1, an initial flag F is set to "0" and the maximum variation amount Vm is set to "0".

In S2, the air-fuel-ratio obtaining portion 32 obtains the air-fuel ratio from the A/F sensor 26.

In S3, it is determined whether the initial flag F is "0". When the answer is YES in S3, the procedure proceeds to S4. When the answer is NO in S3, the procedure proceeds to S5.

In S4, the current air-fuel ratio "AF" is stored in the RAM as the initial air-fuel ratio AF_i, and the initial flag F is set to "1".

In S5, an absolute value |AF_i−AF| of a difference between the initial air-fuel ratio AF_i and the current air-fuel ratio AF is computed as a variation amount.

In S6, it is determined whether the variation amount |AF_i−AF| computed in S5 is greater than the maximum variation amount Vm. When the answer is YES in S6, the procedure proceeds to S7. When the answer is NO in S6, the procedure proceeds to S8.

In S7, the variation amount |AF_i−AF| computed in S5 is stored in the RAM as the maximum variation amount Vm.

In S8, it is determined whether a specified time period "T" has elapsed after the purge valve 15 is opened. When the answer is YES in S8, the procedure proceeds to S9. When the answer is NO in S8, the procedure goes back to S2.

In S9, it is determined whether the maximum variation amount Vm is less than or equal to the threshold value "J". When the answer is YES in S9, the procedure proceeds to S10. When the answer is NO in S9, the procedure proceeds to S12.

In S10, it is determined that the purge line 30 is clogged. Then, the procedure proceeds to S11 in which an alarm is generated to indicate that the purge line 30 is clogged. In step S12, it is determined that the purge line 30 is not clogged.

(Advantages)

According to the first embodiment, the fuel vapor treatment apparatus 10 is applied to the engine 1 in which an injection quantity of the fuel injector 25 is controlled to a target value. The fuel vapor treatment apparatus 10 is provided with the canister 11, the first pipe 12, the second pipe 13, the purge valve 15, the valve driving portion 31, the air-fuel-ratio obtaining portion 32 and the clogging determining portion 35.

The first pipe 12 defines the first passage 22 fluidly connecting the fuel tank 6 and the canister 11 with each other. The second pipe 13 defines the second passage 23 fluidly connecting the canister 11 and the intake passage 3. The purge valve 15 opens and closes the second passage 23. The valve driving portion 31 drives the purge valve 15. The air-fuel-ratio obtaining portion 32 obtains the air-fuel ratio. The clogging determining portion 35 determines whether the purge line 30 is clogged based on the maximum variation amount Vm.

In a case where no clogging is occurred in the purge line 30, since the fuel injection quantity control is delayed a little when the purge valve 15 is opened, the air-fuel ratio significantly fluctuates temporarily. Meanwhile, in a case where at least a part of the purge line 30 is fully clogged, even when the purge valve 15 receives a valve opening command to be opened, the fuel vapor cannot be introduced into the engine 1, so that the air-fuel ratio is not varied. Also, in a case where at least a part of the purge line 30 is partially clogged, even when the purge valve 15 receives a valve opening command to be opened, the fuel vapor is less introduced into the engine 1, so that the air-fuel ratio is less varied relatively. According to the first embodiment, the clogging determining portion 35 determines whether the purge line 30 is clogged in view of the variation in air-fuel ratio.

Moreover, according to the first embodiment, the ECU 17 is provided with the variation computing portion 34. The variation computing portion 34 computes the maximum variation amount Vm. The clogging determining portion 35 determines whether the purge line 30 is clogged based on the maximum variation amount Vm computed by the variation computing portion 34.

Therefore, the clogging determining portion 35 determines whether the purge line 30 is clogged by comparing the maximum variation amount Vm and the threshold value "J" with each other.

Second Embodiment

Figure 6:
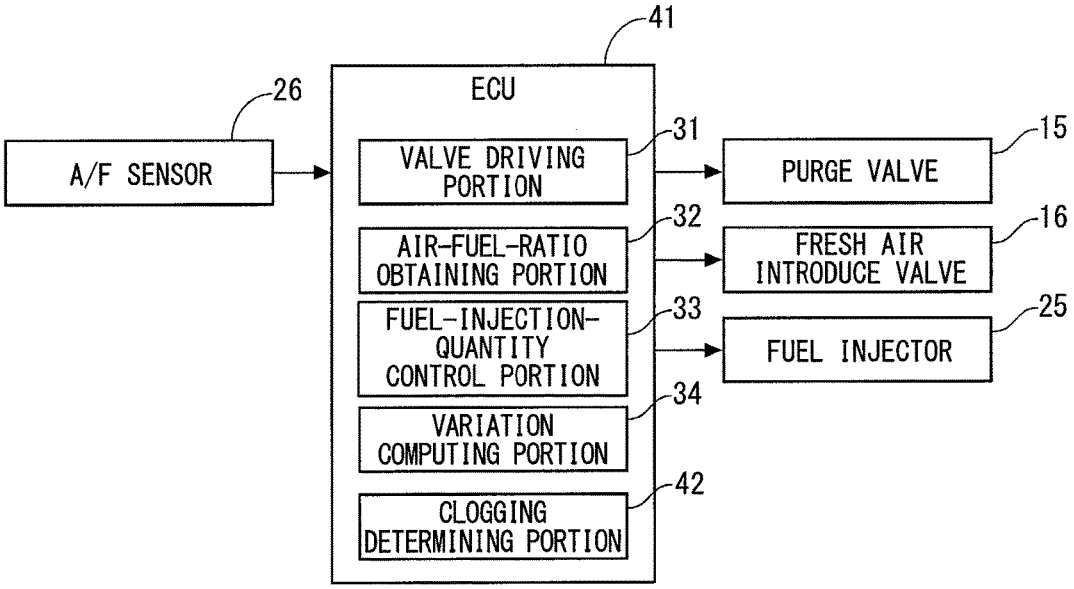
FIG. 6 is a chart for explaining functional portions of an ECU according to a second embodiment.
Figure 7:
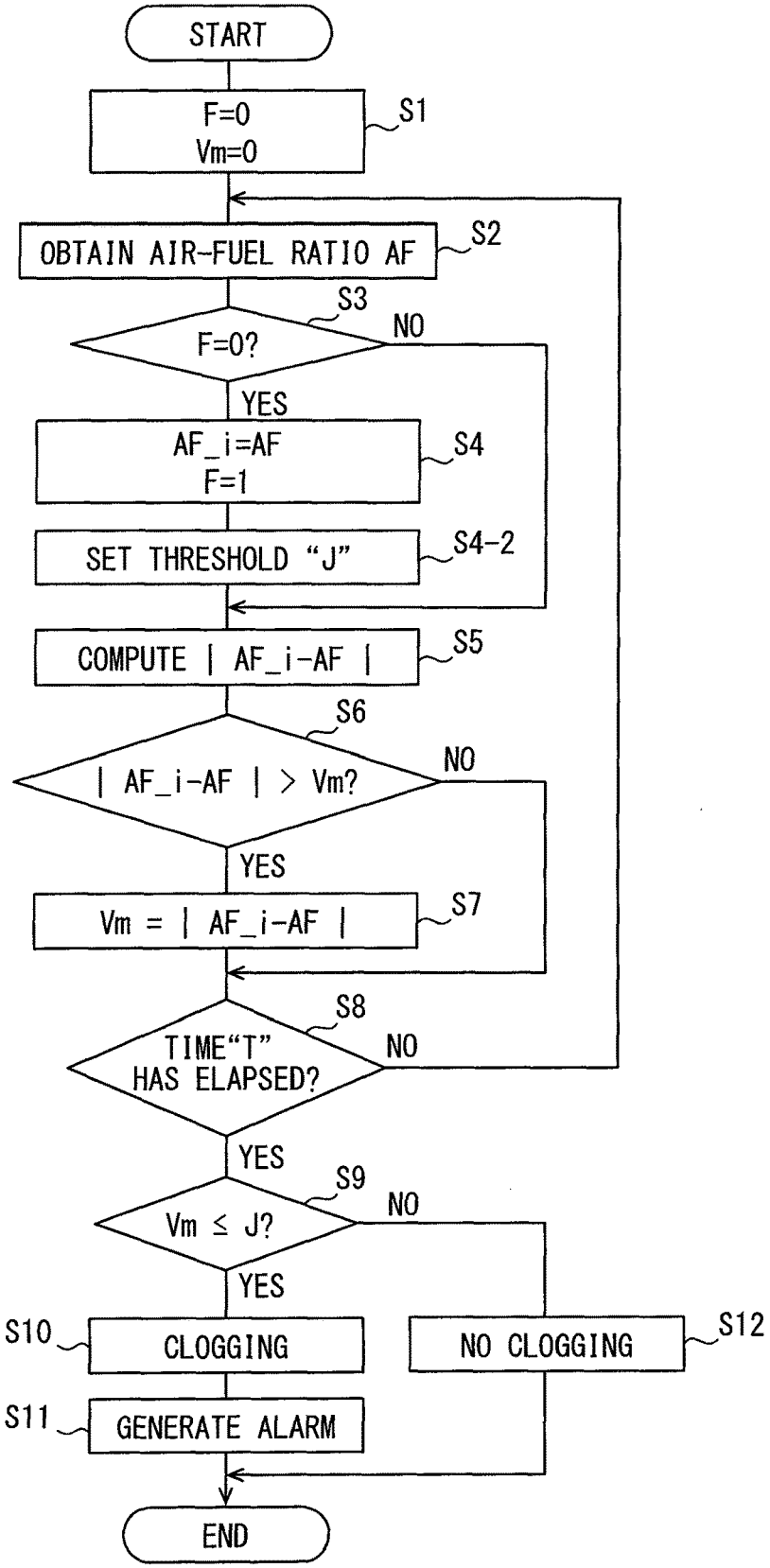
FIG. 7 is a flowchart showing a processing which an ECU shown in FIG. 6 performs.

According to the second embodiment, as shown in FIG. 6, a clogging determining portion 42 establishes the threshold value "J" smaller, as an initial opening degree of the purge valve 15 is smaller. As shown in FIG. 7, in S4-2 after S4, the threshold value "J" is set smaller, as the initial opening degree of the purge valve 15 is smaller. A map indicating a relationship between the opening degree of the purge valve 15 and the threshold value "J" is stored in the ROM in advance.

With the above configuration, even when the variation amount of the air-fuel ratio is relatively small due to a small opening degree of the purge valve 15, it can be determined whether the purge line 30 is clogged.

Third Embodiment

Figure 8:
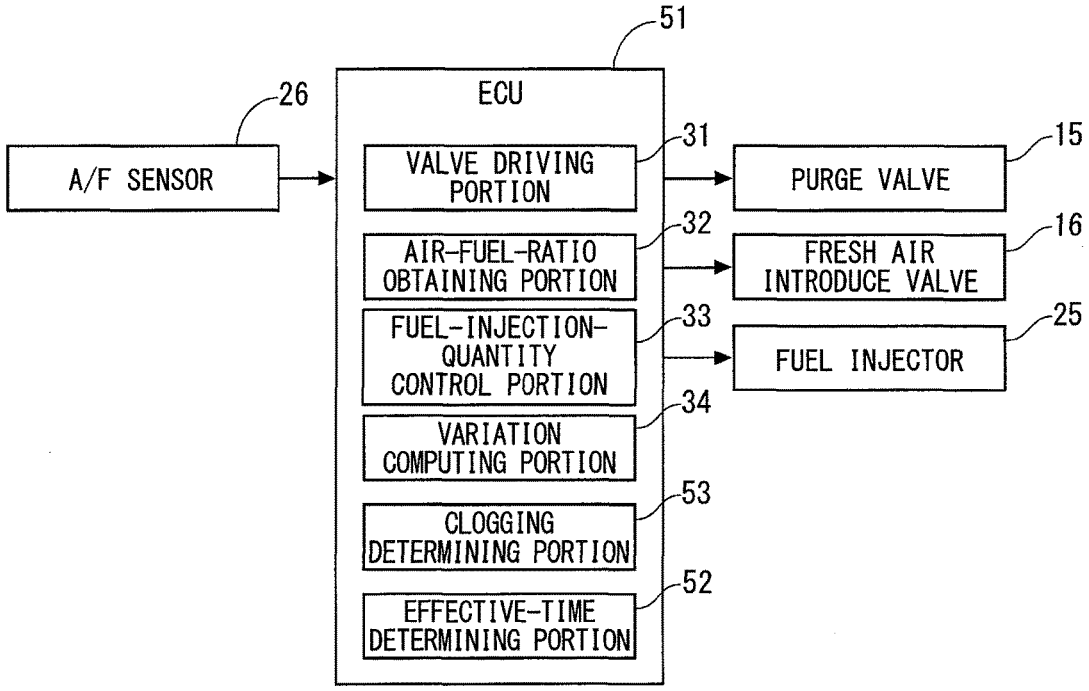
FIG. 8 is a chart for explaining functional portions of an ECU according to a third embodiment.

According to the third embodiment, as shown in FIG. 8, an ECU 51 has an effective-time determining portion 52. The effective-time determining portion 52 determines whether it is in a time period from when the fuel tank 6 is refueled until when a specified effective time elapses. For example, it is determined that the fuel vapor in the fuel tank 6 is adsorbed by the canister 11 prior to an opening of an oil filler port, or it is determined that the fuel tank 6 is refueled based on a signal transmitted from a fuel level sensor level (not shown) or an opening switch for detecting an opening of an oil filler port.

According to the third embodiment, when it is in a time period from when the fuel tank 6 is refueled until when a specified effective time elapses, a clogging determining portion 53 determines whether the purge line 30 is clogged.

With the above configuration, since a clogging determination is performed immediately after refueling at which a lot of fuel vapor is generated, an accuracy of the clogging determination can be enhanced.

OTHER EMBODIMENTS

The variation computing portion may compute an average of air-fuel ratio variation amount, an integrated value of air-fuel ratio variation amount, or a variation rate of air-fuel ratio obtained by the air-fuel-ratio obtaining portion. The clogging determining portion may determine whether the purge line is clogged based on the average of air-fuel ratio variation amount, the integrated value of air-fuel ratio variation amount, or the variation rate of air-fuel ratio.

The clogging determining portion may determine a clogging degree of the purge line in addition to a determination of whether the purge line is clogged. For example, the clogging determining portion determines that the clogging degree of the purge line is larger as the maximum variation amount is smaller.

A shut-off valve may be provided between the fuel tank and the canister. Moreover, a pump may be provided in the purge line. Furthermore, the ECU may be provided with a functional portion which determines whether a fuel leak occurs in the purge line.

As described above, the present disclosure should not be limited to the above-described embodiments, and can be carried out in various modes within the scope without departing from the gist of the present disclosure.

What is claimed is:

1. A fuel vapor treatment apparatus applied to an engine which controls an injection quantity of a fuel injector so that an air-fuel ratio is kept at a target air-fuel ratio, the fuel vapor treatment apparatus treating a fuel vapor generated in a fuel tank by introducing the fuel vapor into the engine, the fuel vapor treatment apparatus comprising:

a canister which adsorbs the fuel vapor;

a first pipe which defines a first passage fluidly connecting the fuel tank and the canister with each other;

a second pipe which defines a second passage fluidly connecting the canister and an intake passage of the engine with each other;

a purge valve which opens and closes the second passage;

a valve driving portion which drives the purge valve to be opened and closed;

an air-fuel-ratio obtaining portion which obtains the air-fuel ratio;

a clogging determining portion which determines an occurrence of clogging in a purge line or determines a clogging degree of the purge line based on the air-fuel ratio which the air-fuel-ratio obtaining portion obtains in a time period from when the purge valve is opened until when a specified time elapses, the purge line being defined by the first passage, the second passage and an inner passage of the purge valve.

2. The fuel vapor treatment apparatus according to claim 1, further comprising:

a variation computing portion which computes a maximum value of an air-fuel ratio variation amount, an average value of the air-fuel ratio variation amount, an integrated value of the air-fuel ratio variation amount, or a variation rate of the air-fuel ratio obtained by the air-fuel-ratio obtaining portion, the air-fuel ratio variation amount being a variation of the air-fuel ratio which is varied from an initial air-fuel ratio in the time period from when the purge valve is opened until when a specified time elapses amount between an initial air-fuel ratio, wherein the clogging determining portion determines the occurrence of clogging in the purge line or determines the clogging degree of the purge line based on the maximum value of an air-fuel ratio variation amount, the average value of the air-fuel ratio variation amount, the integrated value of the air-fuel ratio variation amount, or the variation rate of the air-fuel ratio obtained by the air-fuel-ratio obtaining portion.

3. The fuel vapor treatment apparatus according to claim 2, wherein the clogging determining portion determines that the purge line is clogged when the maximum value of an air-fuel ratio variation amount, the average value of the air-fuel ratio variation amount, the integrated value of the air-fuel ratio variation amount, or the variation rate of the air-fuel ratio obtained by the air-fuel-ratio obtaining portion is less than or equal to a threshold value, and the clogging determining portion sets the threshold vale smaller as an initial opening degree of the purge valve is smaller.

4. The fuel vapor treatment apparatus according to claim 1, further comprising:

an effective-time determining portion which determines whether it is in a time period from when the fuel tank is refueled until when a specified effective time elapses, wherein the clogging determining portion determines the occurrence of clogging in the purge line or determines the clogging degree of the purge line when it is in a time period from when the fuel tank is refueled until when a specified effective time elapses.

* * * * *